US011183771B2

(12) United States Patent
Yokokawa et al.

(10) Patent No.: US 11,183,771 B2
(45) Date of Patent: Nov. 23, 2021

(54) ARRAY ANTENNA DEVICE

(71) Applicant: MITSUBISHI ELECTRIC CORPORATION, Tokyo (JP)

(72) Inventors: Kei Yokokawa, Tokyo (JP); Narihiro Nakamoto, Tokyo (JP); Toru Fukasawa, Tokyo (JP); Tomohiro Takahashi, Tokyo (JP); Masataka Otsuka, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 11 days.

(21) Appl. No.: 16/638,715

(22) PCT Filed: May 18, 2018

(86) PCT No.: PCT/JP2018/019225
§ 371 (c)(1),
(2) Date: Feb. 12, 2020

(87) PCT Pub. No.: WO2019/064683
PCT Pub. Date: Apr. 4, 2019

(65) Prior Publication Data

US 2020/0395676 A1 Dec. 17, 2020

(30) Foreign Application Priority Data

Sep. 28, 2017 (WO) ..... PCT/JP2017/035232

(51) Int. Cl.
*H01Q 21/06* (2006.01)
*H01Q 21/00* (2006.01)
(Continued)

(52) U.S. Cl.
CPC ..... *H01Q 21/0075* (2013.01); *H01Q 1/48* (2013.01); *H01Q 9/0407* (2013.01); *H01Q 21/065* (2013.01)

(58) Field of Classification Search
CPC .... H01Q 21/0075; H01Q 1/38; H01Q 9/0407; H01Q 21/065
See application file for complete search history.

(56) References Cited

U.S. PATENT DOCUMENTS

2007/0080864 A1* 4/2007 Channabasappa ..... H01Q 13/18 343/700 MS
2012/0154238 A1 6/2012 Carpentier et al.
(Continued)

FOREIGN PATENT DOCUMENTS

JP 10-190351 A 7/1998
JP 2009-188895 A 8/2009
(Continued)

OTHER PUBLICATIONS

European Search Report dated Jul. 29, 2020 in corresponding European Patent Application No. 18 863 538.7.
(Continued)

*Primary Examiner* — Hasan Islam
(74) *Attorney, Agent, or Firm* — Birch, Stewart, Kolasch & Birch, LLP

(57) ABSTRACT

Included are: a first dielectric substrate provided with a first conductor ground plane on a front or back surface thereof; a plurality of patch antennas formed in the first conductor ground plane, a plurality of conductive members, ends of which connected to the first conductor ground plane to surround the patch antennas individually, and a second conductor ground plane connected to each of the other ends of the conductive members, and parts of the plurality of conductive members penetrate the first dielectric substrate, and the remaining parts of the conductive members function as spacers for providing an air layer between the first dielectric substrate and the second conductor ground plane, and the plurality of conductive members functions as spac-
(Continued)

ers for providing an air layer between the first conductor ground plane and the second conductor ground plane.

16 Claims, 8 Drawing Sheets

(51) Int. Cl.
*H01Q 1/48* (2006.01)
*H01Q 9/04* (2006.01)

(56) References Cited

U.S. PATENT DOCUMENTS

| | | | | |
|---|---|---|---|---|
| 2014/0151860 | A1 | 6/2014 | Nakamura et al. | |
| 2016/0049723 | A1 | 2/2016 | Baks et al. | |
| 2016/0190704 | A1* | 6/2016 | Celik ..... | H01Q 9/0435 343/700 MS |

FOREIGN PATENT DOCUMENTS

| | | | |
|---|---|---|---|
| WO | WO 2012/167283 | A2 | 12/2012 |
| WO | WO 2013/121732 | A1 | 8/2013 |

OTHER PUBLICATIONS

Khandelwal N. et al: "Active Antenna Module for Low-Cost Electronically Scanned Phased Arrays", IEEE Transactions on Microwave Theory and Techniques, vol. 56, No. 10, Oct. 1, 2008, pp. 2286-2292.

International Search Report for PCT/JP2018/019225 dated Aug. 7, 2018.

Japanese Office Action for Japanese Patent Application No. 2018-557058 dated Dec. 25, 2018.

Pinel et al., "3D integrated LTCC module using μBGA technology for compact C-band RF Front-End Module", 2002 IEEE MTT-S International Microwave Symposium Digest, IEEE, 2002, pp. 1553-1556.

* cited by examiner

ARRAY ANTENNA DEVICE

TECHNICAL FIELD

The present invention relates to an array antenna device including a plurality of patch antennas.

BACKGROUND ART

It is desirable that array antenna devices used for wireless communication, for example, have a high gain and a high axial ratio even with a weak radio wave when scanning with a beam is performed in a wide-angle direction in order to enable wireless communication over the wide angle. The wide-angle direction is a direction in which a radio wave is transmitted/received at ends of the beam width.

A decrease in the gain and the a decrease in the axial ratio when scanning with the beam is performed in the wide-angle direction are caused by a difference in the amplitude between a vertically polarized wave and a horizontally polarized wave in the wide-angle direction, in addition to surface waves generated in a dielectric substrate on which patch antennas are formed.

An array antenna device disclosed in the following Patent Literature 1 employs a substrate having a low dielectric constant characteristic such as foam as a dielectric substrate in order to suppress a decrease in the gain and a decrease in the axial ratio when scanning with a beam is performed in a wide-angle direction.

A difference in the amplitude between a vertically polarized wave and a horizontally polarized wave in the wide-angle direction can be changed by adjusting the thickness of the substrate having a low dielectric constant characteristic such as foam. In this array antenna device, a screw is used to adjust the thickness of the substrate.

CITATION LIST

Patent Literature

Patent Literature 1: JP 2009-188895 A

SUMMARY OF INVENTION

Technical Problem

Since the array antenna devices are configured as described above, the thickness of the substrate can be adjusted by the screws.

In this example, the amount of adjustment of the thickness of the substrate is proportional to the amount of rotation of the screw, and the amount of rotation of the screw is dependent on the pitch of the screw thread. For this reason, the adjustment accuracy of the thickness of a substrate can be improved as the pitch of a screw thread becomes narrower.

For example in a case where the frequency band of a beam is high such as the Kurz-above (Ka) band or a millimeter wave band, it is necessary to use a screw having a thread pitch in the order of micrometers in order to implement a desired adjustment accuracy.

However, since it is difficult to manufacture a screw having a thread pitch in the order of micrometers, there are cases where the thickness of the substrate cannot be adjusted with high accuracy and the thickness of the substrate cannot be adjusted to a desired thickness. It is a disadvantage in that, as a result, a decrease in the gain and a decrease in the axial ratio cannot be suppressed when scanning with a beam is performed in the wide-angle direction.

The present invention has been devised in order to solve the above disadvantage, and it is an object of the present invention to obtain an array antenna device capable of suppressing a decrease in the gain and a decrease in the axial ratio when scanning with a beam is performed in the wide-angle direction.

Solution to Problem

An array antenna device according to the present invention includes a first dielectric substrate provided with a first conductor ground plane on a front surface or a back surface thereof, a plurality of patch antennas provided in the first conductor ground plane, a plurality of conductive members, ends of which are connected to the first conductor ground plane to surround the patch antennas individually, and a second conductor ground plane connected to each of other ends of the conductive members, wherein in a case where the first conductor ground plane is provided on the front surface of the first dielectric substrate, a part of the plurality of conductive members penetrates the first dielectric substrate, and a remaining part of the plurality of conductive members functions as spacers for providing an air layer between the first dielectric substrate and the second conductor ground plane, and in a case where the first conductor ground plane is provided on the back surface of the first dielectric substrate, the plurality of conductive members functions as spacers for providing an air layer between the first conductor ground plane and the second conductor ground plane, and wherein the conductive member adjacent to at least two or more patch antennas, out of the plurality of conductive members, is disposed at a position equidistant from a center of each of the at least two or more patch antennas adjacent to each other.

Advantageous Effects of Invention

According to the present invention, in a case where the first conductor ground plane is formed on the front surface of the first dielectric substrate, a part of the plurality of conductive members penetrates the first dielectric substrate, and the remaining part of the plurality of conductive members functions as spacers for providing an air layer between the first dielectric substrate and the second conductor ground plane, and in a case where the first conductor ground plane is formed on the back surface of the first dielectric substrate, the plurality of conductive members functions as spacers for providing an air layer between the first conductor ground plane and the second conductor ground plane. Therefore, there is an effect of suppressing a decrease in the gain and a decrease in the axial ratio when scanning with a beam is performed in the wide-angle direction.

DESCRIPTION OF EMBODIMENTS

To describe the present invention further in detail, embodiments for carrying out the present invention will be described below with reference to accompanying drawings.

First Embodiment

Figure 1:
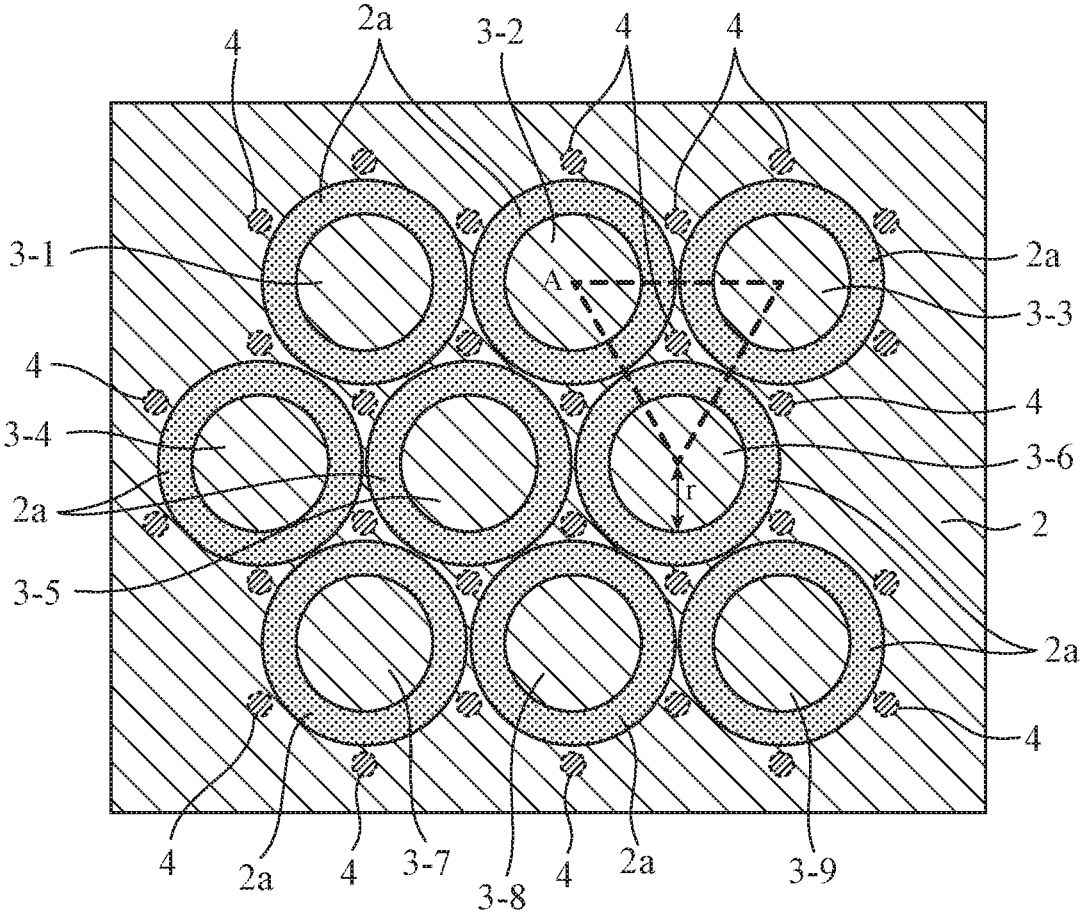
FIG. 1 is a plan view illustrating an array antenna device according to a first embodiment of the present invention.

FIG. 1 is a plan view illustrating an array antenna device according to a first embodiment of the present invention.

Figure 2:
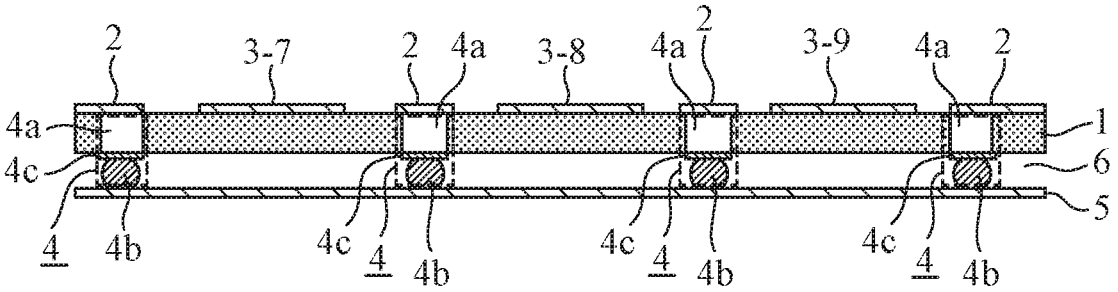
FIG. 2 is a cross-sectional view illustrating the array antenna device according to the first embodiment of the invention.

FIG. 2 is a cross-sectional view illustrating the array antenna device according to the first embodiment of the present invention.

In FIGS. 1 and 2, a first dielectric substrate 1 is provided with a first conductor ground plane 2 formed on a front surface thereof.

The front surface of the first dielectric substrate 1 is the surface on the upper side in FIG. 2 out of the two surfaces of the first dielectric substrate 1, and the back surface of the first dielectric substrate 1 is the surface on the lower side in FIG. 2.

The first conductor ground plane 2 is a ground plane of copper foil formed on the front surface of the first dielectric substrate 1.

Patch antennas 3-1 to 3-9 are circular patch antennas provided on the first conductor ground plane 2.

Hereinafter, when the individual patch antennas 3-1 to 3-9 are not distinguished, they may be referred to as the patch antennas 3.

In FIG. 1 and FIG. 2, the patch antennas 3-1 to 3-9 are formed by scraping the first conductor ground plane 2 in annular shapes. A conductor-cut-out portion 2*a* indicates an annular cut-out portion in the first conductor ground plane 2.

Although nine patch antennas 3 are illustrated as an example in FIGS. 1 and 2, the number of patch antennas 3 is only required to be plural and not limited to nine.

To simplify the drawing, the patch antennas 3-7 to 3-9 are representatively illustrated in FIG. 2.

In the first embodiment, an example is illustrated in which each of the patch antennas 3-1 to 3-9 has a circular shape; however, the shape is not limited to a circle and may be, for example, a polygon.

Conductive members 4 each include a first connection conductor 4*a* and a second connection conductor 4*b*, and ends of the conductive members 4 are coupled to the first conductor ground plane 2 so as to surround the patch antennas 3-1 to 3-9 individually.

The first connection conductor 4*a* which is a part of the conductive member 4 is provided so as to penetrate the first dielectric substrate 1, and one end thereof is coupled to the first conductor ground plane 2 at a position surrounding any of the patch antennas 3-1 to 3-9.

The second connection conductor 4*b*, which is the remaining part of the conductive member 4, is a copper core ball that conducts between the other end of the first connection conductor 4*a* and a second conductor ground plane 5.

The second connection conductor 4*b* functions as a spacer for providing an air layer 6 between the first dielectric substrate 1 and the second conductor ground plane 5.

Although the example in which the second connection conductor 4*b* is a copper core ball is illustrated here, the second connection conductor 4*b* is not limited to a sphere and may be, for example, a cube or a rectangular parallelepiped.

A land 4*c* is a portion where the first connection conductor 4*a* and the second connection conductor 4*b* are coupled by solder.

The second conductor ground plane 5 is a ground plane of copper foil coupled to each of the other ends of second connection conductors 4*b* in a plurality of conductive members 4.

The air layer 6 is a layer between the first dielectric substrate 1 and the second conductor ground plane 5 formed by the second connection conductors 4*b*.

Next, the operation will be described.

In the array antenna device according to the first embodiment, the patch antennas 3-1 to 3-9 are formed by removing the first conductor ground plane 2 in the annular shapes like in the conductor-cut-out portions 2*a* illustrated in FIG. 1.

The plurality of conductive members 4 is provided in the first dielectric substrate 1 in such a manner that ends of the conductive members 4 surround the patch antennas 3-1 to 3-9 individually.

Specifically, the conductive members 4 each include a first connection conductor 4*a* and a second connection conductor 4*b*, and the first connection conductors 4*a* are provided so as to penetrate the first dielectric substrate 1 with the ends thereof coupled to the first conductor ground plane 2 at positions surrounding one patch antenna 3 out of the patch antennas 3-1 to 3-9.

An end of a second connection conductor 4*b* is coupled to the other end of a first connection conductor 4*a*, and the other end of the second connection conductor 4*b* is coupled to the second conductor ground plane 5.

Here, the second connection conductor 4*b* functions as a spacer for providing the air layer 6 between the first dielectric substrate 1 and the second conductor ground plane 5.

The size of the air layer 6, which is the length of an interval between the first dielectric substrate 1 and the second conductor ground plane 5, corresponds to the diameter of the second connection conductor 4*b* which is a copper core ball.

By providing the air layer 6 between the first dielectric substrate 1 and the second conductor ground plane 5, a low dielectric constant substrate can be equivalently implemented.

In addition, a difference in the amplitude between a vertically polarized wave and a horizontally polarized wave in the wide-angle direction can be reduced by adjusting the size of the air layer 6.

In order to suppress a decrease in the gain and a decrease in the axial ratio when scanning with a beam is performed in the wide-angle direction, it is only required to adjust the size of the air layer 6 in such a manner that a difference in the amplitude between a vertically polarized wave and a horizontally polarized wave in the wide-angle direction is reduced.

Since the size of the air layer 6 corresponds to the diameter of the second connection conductor 4*b*, it is only required to use a second connection conductor 4*b* having a diameter that allows a difference in the amplitude between the vertically polarized wave and the horizontally polarized wave in the wide-angle direction to be reduced.

However, in a case where the frequency band of the beam is high such as the Ka band or a millimeter wave band, the size of the air layer 6 needs to be adjusted in the order of micrometers, and thus it is necessary to use second connection conductors 4*b* manufactured with accuracy in the order of micrometers.

Since it is easier to manufacture copper core balls with high accuracy as compared to manufacturing screws having a narrow thread pitch, it is easy to manufacture copper core balls with accuracy in the order of micrometers. Thus, it is possible to use second connection conductors 4*b* having a desired diameter.

The example in which the patch antennas 3-1 to 3-9 are formed is illustrated in the first embodiment. Focusing on three adjacent patch antennas 3 out of the patch antennas 3-1 to 3-9, it is desirable that the three patch antennas 3 are disposed in such a manner that a distance between the centers of each pair of the three patch antennas 3 approximately equals a half the wavelength of a frequency of the beam to be transmitted and received.

For example, focusing on the patch antenna 3-2, 3-3, and 3-6 as three adjacent patch antennas 3, the patch antennas 3-2, 3-3, and 3-6 are disposed in such a manner that lines connecting the centers of the three patch antennas become an equilateral triangle A.

The distance between the center of patch antenna 3-2 and the center of patch antenna 3-3 is approximately half the wavelength of the frequency of the beam, and the distance between the center of patch antenna 3-3 and the center of patch antenna 3-6 is approximately half the wavelength of the frequency of the beam. The distance between the center of patch antenna 3-6 and the center of patch antenna 3-2 is approximately half the wavelength of the frequency of the beam.

The radius r of the patch antennas 3-1 to 3-9 is expressed as the following equation (1), using an effective dielectric constant $\varepsilon_r$ calculated from the first dielectric substrate 1 and the air layer 6.

$$r = \frac{c}{4\left(f \times \sqrt{\varepsilon_r}\right)} \tag{1}$$

In equation (1), c represents the speed of light, and f represents the frequency of the beam.

The effective dielectric constant $\varepsilon_r$ is expressed as the following equation (2), where the thickness of the first dielectric substrate 1 is denoted by $t_1$, a dielectric constant of the first dielectric substrate 1 is denoted by $\varepsilon_{r1}$, the thickness of the air layer 6 is denoted by $t_2$, and the dielectric constant of the air layer 6 is denoted by $\varepsilon_{r2}$.

$$\varepsilon_r = \frac{t_1 + t_2}{\frac{t_1}{\varepsilon_{r1}} + \frac{t_2}{\varepsilon_{r2}}} \tag{2}$$

The conductive members 4 are disposed at positions surrounding the patch antennas 3-1 to 3-9 individually.

As one of the positions where the conductive members 4 are disposed, for example, the center of gravity of the equilateral triangle A, which is a position equidistant from the patch antennas 3-2, 3-3, and 3-6 is conceivable.

The diameter of the conductor-cut-out portions 2*a* surrounding the patch antennas 3-1 to 3-9 is determined in such a manner that an equivalent patch radius from the center of the patch antennas 3-1 to 3-9 (hereinafter referred to as "effective radius") results in an axial ratio characteristic of approximately 0 dB in a target maximum angle of the beam scanning angle. As the target maximum angle of the beam scanning angle, for example, a beam scanning angle of ±60 degrees is conceivable.

Figure 3:
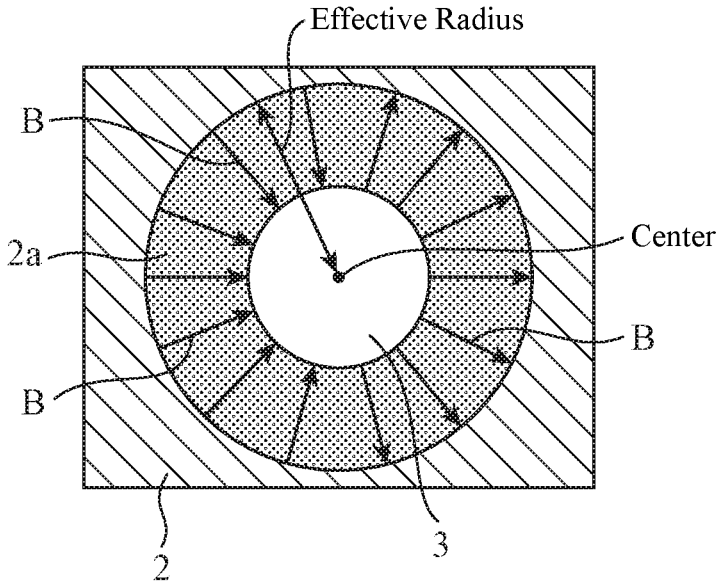
FIG. 3 is an explanatory diagram illustrating an effective radius.

An effective radius is an electrical radius of the patch antennas 3 in consideration of the spread of an electric field B generated in the patch antennas 3 when the power is being fed as illustrated in FIG. 3.

FIG. 3 is an explanatory diagram illustrating an effective radius.

It is known that the axial ratio of the patch antennas 3-1 to 3-9 can be adjusted by the effective radius.

Specifically, in the case where the effective dielectric constant $\varepsilon_r$ is about 1.3 and when the effective radius of the patch antennas 3-1 to 3-9 is about 0.26λ, the axial ratio in the wide-angle direction is obtained as 0 dB, and a resonance characteristic is obtained at the frequency of the beam. Symbol λ represents the wavelength at the frequency of a beam used.

Therefore, the first conductor ground plane 2 positioned between about 0.26λ away from the center of the patch antennas 3-1 to 3-9 and the perimeters of the patch antennas 3-1 to 3-9 is each cut out into an annual shape.

Note that there are cases where conductor-cut-out portions 2*a* of adjacent patch antennas 3 overlap with each other since the radius r of the adjacent patch antennas 3 is large and thus intervals in the arrangement of the adjacent patch antenna 3 become narrow. Since it is only required that adjacent patch antennas 3 do not overlap with each other, conductor-cut-out portions 2*a* of the adjacent patch antennas 3 may overlap with each other.

As apparent from the above, according to the first embodiment, parts of the plurality of conductive members 4 penetrate the first dielectric substrate 1 while the remaining parts of the plurality of conductive members 4 function as spacers for providing the air layer 6 between the first dielectric substrate 1 and the second conductor ground plane 5, thereby exercising effects of suppressing a decrease in the gain and a decrease in the axial ratio when scanning with a beam is performed in the wide-angle direction.

Since the remaining parts of the conductive members 4 functioning as spacers are the second connection conductor 4*b* that can be manufactured with accuracy in the order of micrometers, the size of the air layer 6 can be adjusted in the order of micrometers, thereby suppressing a decrease in the gain and a decrease in the axial ratio when scanning with a beam is performed in the wide-angle direction.

Figure 4:
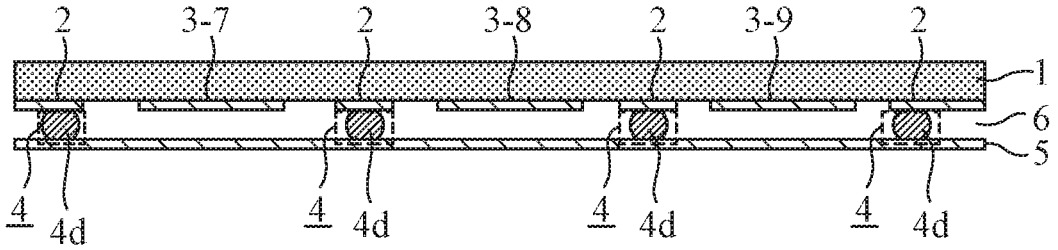
FIG. 4 is a cross-sectional view illustrating another array antenna device according to the first embodiment of the invention.

The example is illustrated in the first embodiment in which the first conductor ground plane 2 is formed on the front surface of the first dielectric substrate 1; however as illustrated in FIG. 4, the first conductor ground plane 2 may be formed on the back surface of the first dielectric substrate 1.

FIG. 4 is a cross-sectional view illustrating another array antenna device according to the first embodiment of the invention. In FIG. 4, the same symbol as that in FIGS. 1 and 2 represents the same or a corresponding part and thus description thereof is omitted.

A conductive member 4 illustrated in FIG. 2 includes a first connection conductor 4*a* and a second connection conductor 4*b*, whereas a conductive member 4 illustrated in FIG. 4 includes only a first connection conductor 4*d*.

The first connection conductor 4*d* is a copper core ball one end of which is coupled to a first conductor ground plane 2 at a position surrounding any one of patch antennas 3-1 to 3-9, and the other end of which is coupled to a second conductor ground plane 5.

The first connection conductor 4*d* functions as a spacer for providing an air layer 6 between the first conductor ground plane 2 and the second conductor ground plane 5.

Since the air layer 6 is provided also in the array antenna device illustrated in FIG. 4, a low dielectric constant substrate can be equivalently implemented like in the array antenna device illustrated in FIGS. 1 and 2.

Therefore, also in the array antenna device illustrated in FIG. 4, it is possible to suppress a decrease in the gain and a decrease in the axial ratio when scanning with a beam is performed in the wide-angle direction like in the array antenna device illustrated in FIGS. 1 and 2.

Second Embodiment

The first embodiment has illustrated the array antenna device including the first dielectric substrate 1, whereas in a second embodiment an array antenna device including a first dielectric substrate 1 and a second dielectric substrate 7 will be described.

Figure 5:
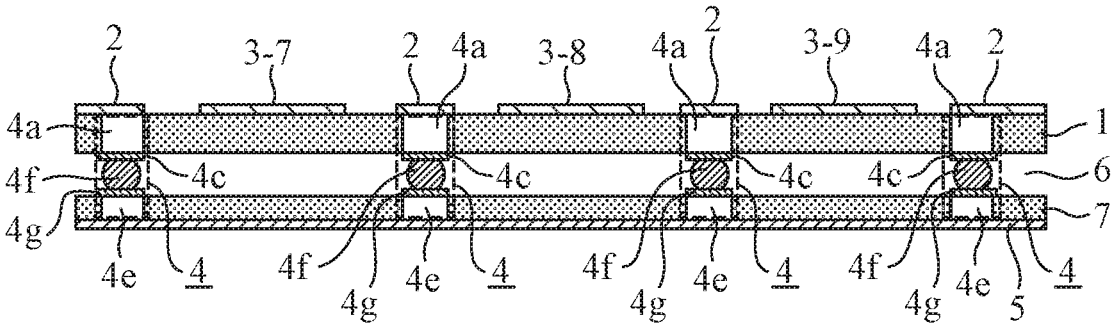
FIG. 5 is a cross-sectional view illustrating an array antenna device according to a second embodiment of the present invention.

FIG. 5 is a cross-sectional view illustrating an array antenna device according to the second embodiment of the present invention.

A plan view of the array antenna device of the second embodiment is illustrated in FIG. 1 as in the first embodiment.

In FIG. 5, the same symbol as that in FIGS. 1 and 2 represents the same or a corresponding part and thus description thereof is omitted.

The second dielectric substrate 7 is disposed between the first dielectric substrate 1 and a second conductor ground plane 5.

Conductive members 4 each include a first connection conductor 4*a*, a second connection conductor 4*e*, and a third connection conductor 4*f*, and ends of the conductive members 4 are coupled to the first conductor ground plane 2 so as to surround each of patch antennas 3-1 to 3-9.

A second connection conductor 4*e* which is a part of a conductive member 4 is provided so as to penetrate the second dielectric substrate 7, and one end thereof is coupled to the second conductor ground plane 5.

A third connection conductor 4*f*, which is the remaining part of the conductive member 4, is a copper core ball that conducts between the other end of the first connection conductor 4*a* and the other end of the second connection conductor 4*e*.

The third connection conductor 4*f* functions as a spacer for providing an air layer 6 between the first dielectric substrate 1 and the second dielectric substrate 7.

Although the example in which the third connection conductor 4*f* is a copper core ball is illustrated here, the third connection conductor 4*f* is not limited to a sphere and may be, for example, a cube, or a rectangular parallelepiped.

A land 4*g* is a portion where the second connection conductor 4*e* and the third connection conductor 4*f* are coupled by solder.

Although the second dielectric substrate 7 is included in addition to the first dielectric substrate 1 in the second embodiment, since the air layer 6 is provided, a low dielectric constant substrate can be equivalently implemented like in the first embodiment.

Thus, like in the first embodiment described above, it is possible to suppress a decrease in the gain and a decrease in the axial ratio when scanning with a beam is performed in the wide-angle direction.

In the second embodiment, however, since the second dielectric substrate 7 is included in addition to the first dielectric substrate 1, the effective dielectric constant $\varepsilon_r$ is calculated from the first dielectric substrate 1, the second dielectric substrate 7, and the air layer 6.

The effective dielectric constant $\varepsilon_r$ is expressed as the following equation (3), where the thickness of the first dielectric substrate 1 is denoted by $t_1$, the dielectric constant of the first dielectric substrate 1 is denoted by $\varepsilon_{r1}$, the thickness of the air layer 6 is denoted by $t_2$, the dielectric constant of the air layer 6 is denoted by $\varepsilon_{r2}$, the thickness of the second dielectric substrate 7 is denoted by $t_3$, the dielectric constant of the second dielectric substrate 7 is denoted by $\varepsilon_{r3}$.

$$\varepsilon_r = \frac{t_1 + t_2 + t_3}{\frac{t_1}{\varepsilon_{r1}} + \frac{t_2}{\varepsilon_{r2}} + \frac{t_3}{\varepsilon_{r3}}} \tag{3}$$

Figure 6:
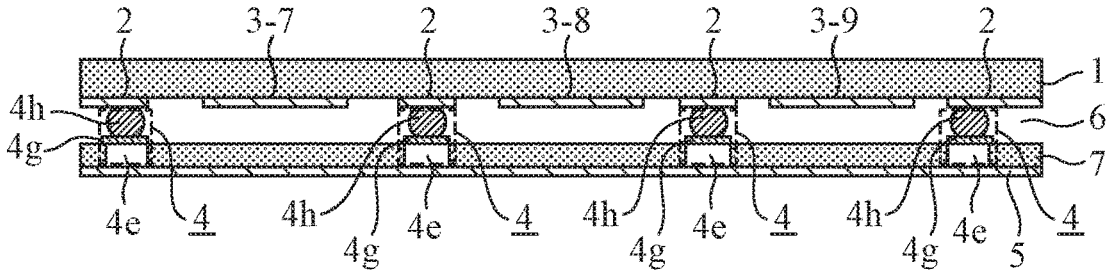
FIG. 6 is a cross-sectional view illustrating another array antenna device according to the second embodiment of the invention.

The example is illustrated in the second embodiment in which the first conductor ground plane 2 is formed on the front surface of the first dielectric substrate 1; however as illustrated in FIG. 6, the first conductor ground plane 2 may be formed on the back surface of the first dielectric substrate 1.

FIG. 6 is a cross-sectional view illustrating another array antenna device according to the second embodiment of the invention. In FIG. 6, the same symbol as that in FIGS. 1 and 5 represents the same or a corresponding part and thus description thereof is omitted.

The conductive members 4 illustrated in FIG. 5 each include a first connection conductors 4*a*, a second connection conductors 4*e*, and a third connection conductor 4*f*; whereas conductive members 4 illustrated in FIG. 6 each include only a first connection conductor 4*h* and a second connection conductor 4*e*.

The first connection conductor 4*h* is a copper core ball one end of which is coupled to a first conductor ground plane 2 at a position surrounding any one of patch antennas 3-1 to 3-9.

The first connection conductor 4*h* functions as a spacer for providing an air layer 6 between the first conductor ground plane 2 and a second dielectric substrate 7.

Since the air layer 6 is provided also in the array antenna device illustrated in FIG. 6, a low dielectric constant substrate can be equivalently implemented like in the array antenna device illustrated in FIG. 5.

Therefore, also in the array antenna device illustrated in FIG. 6, it is possible to suppress a decrease in the gain and a decrease in the axial ratio when scanning with a beam is performed in the wide-angle direction like in the array antenna device illustrated in FIG. 5.

Third Embodiment

In the third embodiment, an array antenna device including first striplines 13, second striplines 15, and slots 17 as feed line portions 10 will be described.

Figure 7:
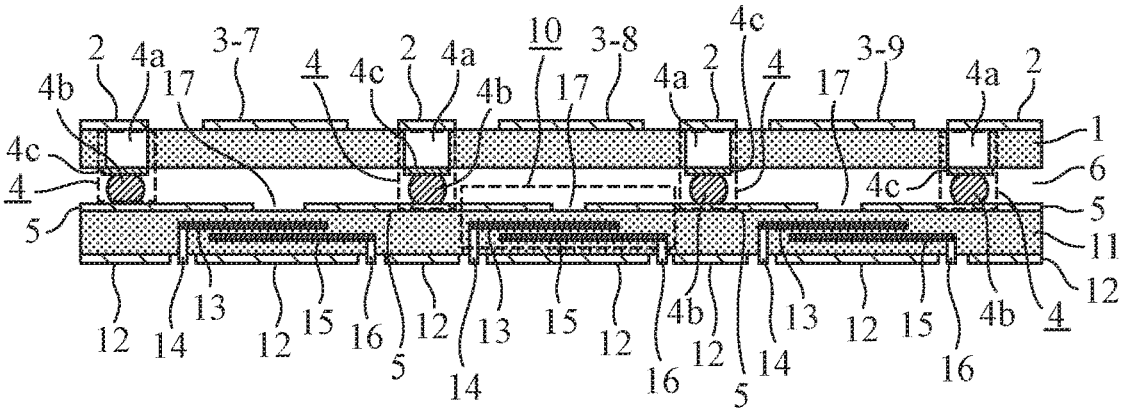
FIG. 7 is a cross-sectional view illustrating an array antenna device according to a third embodiment of the invention.

FIG. 7 is a cross-sectional view illustrating an array antenna device according to the third embodiment of the present invention.

A plan view of the array antenna device of the third embodiment is illustrated in FIG. 1 as in the first embodiment.

In FIG. 7, the same symbol as that in FIGS. 1 and 2 represents the same or a corresponding part and thus description thereof is omitted.

A second dielectric substrate 11 is disposed on, out of the two planes of a second conductor ground plane 5, a plane opposite to the plane to which conductive members 4 are coupled.

A third conductor ground plane 12 is a ground plane of copper foil disposed on, out of the two planes of the second dielectric substrate 11, a plane opposite to the plane on which the second conductor ground plane 5 is disposed.

A first stripline 13 is provided at a position facing one patch antenna 3 out of the patch antennas 3-1 to 3-9 inside the second dielectric substrate 11.

A second stripline 15 is provided at a position facing one patch antenna 3 out of the patch antennas 3-1 to 3-9 inside the second dielectric substrate 11.

A via 14 is a connecting member for electrically connecting a first stripline 13 and an adjustment circuit for, for example, adjusting the phase and the amplitude of signals.

A via 16 is a connecting member for electrically connecting a second stripline 15 and an adjustment circuit for, for example, adjusting the phase and the amplitude of signals.

A slot 17 is included in the second conductor ground plane 5 at a position facing one patch antenna 3 out of the patch antennas 3-1 to 3-9.

The slot 17 excites the patch antenna 3 at the opposite position when power is fed from the first stripline 13 and the second stripline 15.

Figure 8:
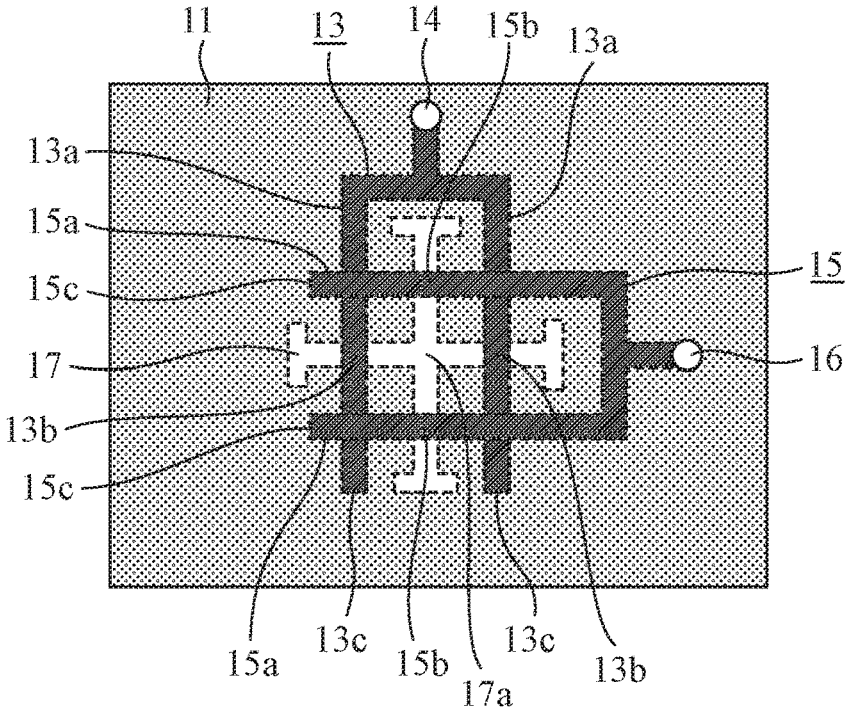
FIG. 8 is an explanatory diagram illustrating the positional relationship among a first stripline 13, a second stripline 15, and a slot 17 in the array antenna device illustrated in FIG. 7.

FIG. 8 is an explanatory diagram illustrating the positional relationship among a first stripline 13, a second stripline 15, and a slot 17 in the array antenna device illustrated in FIG. 7.

The explanatory diagram of FIG. 8 is a view in which the first stripline 13, the second stripline 15, and the slot 17 are viewed transparently from the lower side toward the upper side of FIG. 7.

In FIG. 7, in order to simplify the drawing, the positions where vias 14 and 16 are drawn are schematic, and the exact positions of the vias 14 and 16 are illustrated in FIG. 8.

One end of the first stripline 13 is coupled to the via 14.

The first stripline 13 is branched into two on the way, and two branch lines 13*a* of the first stripline 13 are disposed in parallel so as to maintain the symmetry of the first stripline 13.

One end of the second stripline 15 is coupled to the via 16.

The second stripline 15 is branched into two on the way, and two branch lines 15*a* of the second stripline 15 are disposed in parallel so as to maintain the symmetry of the second stripline 15.

The shape of the slot 17 is substantially cruciform, and the center 17*a* of the slot 17 substantially coincides with the center of a patch antenna 3 at the opposite position.

Also, at the midpoints of the two branch lines 13*a*, the length from a midpoint 13*b* at a position overlapping with the slot 17 to a tip 13*c* is approximately a quarter of the wavelength of a frequency of the beam in order to enhance the feeding efficiency of the slot 17.

At the midpoints of the two branch lines 15*a*, the length from a midpoint 15*b* at a position overlapping with the slot 17 to a tip 15*c* is approximately a quarter of the wavelength of a frequency of the beam in order to enhance the feeding efficiency of the slot 17.

Next, the operation will be described.

The first stripline 13 in the feed line portion 10 is fed with, for example, a first polarized wave, and the second stripline 15 is fed with a second polarized wave orthogonal to the first polarized wave.

The slot 17 in the feed line portion 10 has a cross slot structure in which orthogonal polarized waves can be excited, and the first polarized wave and the second polarized wave are fed with power in a contactless manner from the first stripline 13 and the second stripline 15.

The slot 17 is coupled to the patch antenna 3 at the opposite position and excites the patch antenna 3 at the opposite position when the first polarized wave and the second polarized wave are fed with power in a contactless manner from the first stripline 13 and the second stripline 15.

As a result, the slot 17 and the patch antenna 3 operate as an antenna.

Since the patch antennas 3 are excited using the slots 17 in the third embodiment, it is possible to implement an array antenna device in which cross polarization is suppressed.

Moreover, since polarized waves orthogonal to each other are fed to the first striplines 13 and the second striplines 15, a circularly polarized wave can be radiated from the patch antennas 3.

Figure 9:
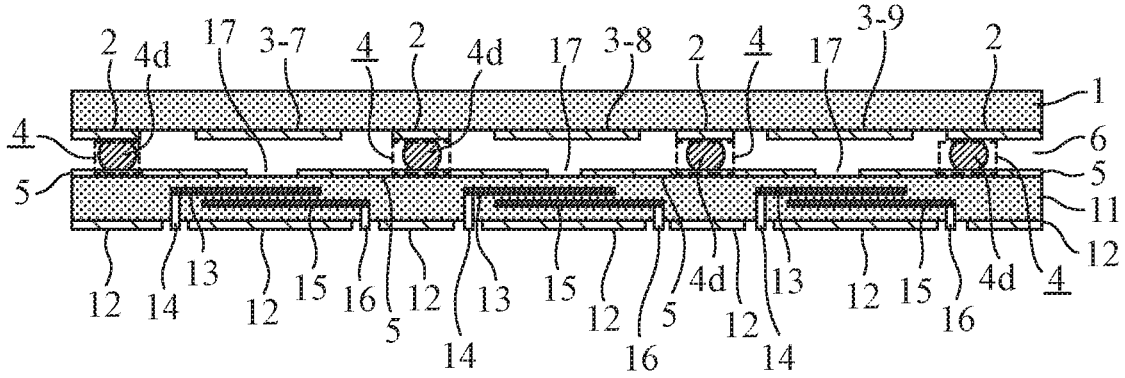
FIG. 9 is a cross-sectional view illustrating another array antenna device according to the third embodiment of the invention.

The example is illustrated in the third embodiment in which the first conductor ground plane 2 is formed on the front surface of the first dielectric substrate 1; however as illustrated in FIG. 9, the first conductor ground plane 2 may be formed on the back surface of the first dielectric substrate 1.

FIG. 9 is a cross-sectional view illustrating another array antenna device according to the third embodiment of the invention.

In FIG. 9, the same symbol as that in FIGS. 1, 4, and 7 represents the same or a corresponding part.

Even in a case where the first conductor ground plane 2 is formed on the back surface of the first dielectric substrate 1, a slot 17 can excite a patch antenna 3 at the opposite position like in the case where the first conductor ground plane 2 is formed on the front surface of the first dielectric substrate 1.

Figure 10:
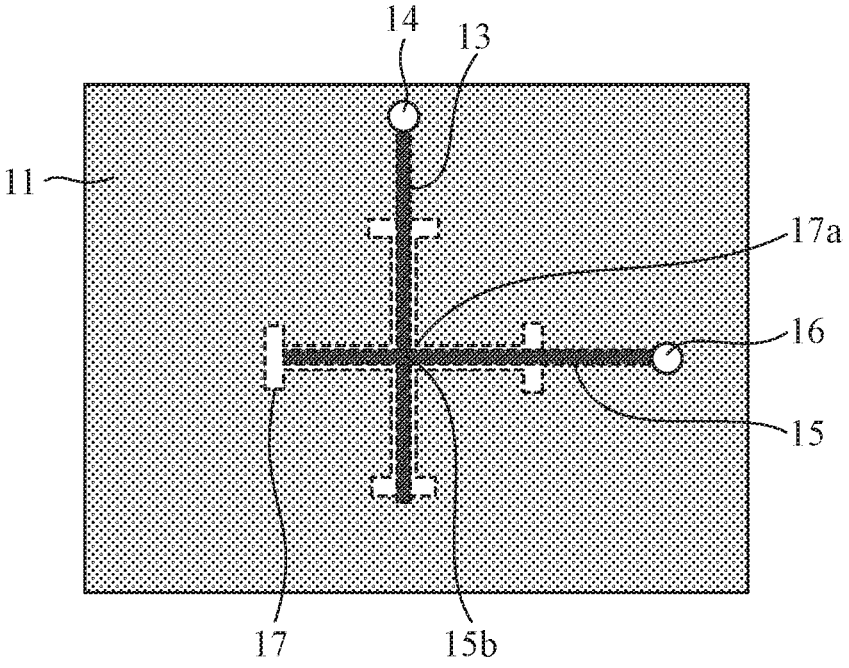
FIG. 10 is an explanatory diagram illustrating the positional relationship among a first stripline 13, a second stripline 15, and a slot 17.

The example has been illustrated in the third embodiment in which the first stripline 13 and the second stripline 15 are each branched into two on the way; however, the present invention is not limited to those branching into two, and a first stripline 13 and a second stripline 15 may be linear as illustrated in FIG. 10.

FIG. 10 is an explanatory diagram illustrating the positional relationship among a first stripline 13, a second stripline 15, and a slot 17.

In FIG. 10, the example is illustrated in which the first stripline 13 and the second stripline 15 are disposed in such a manner that each of a midpoint 13*b* of the first stripline 13 and a midpoint 15*b* of the second stripline 15 coincides with the center 17*a* of the slot 17.

Figure 11:
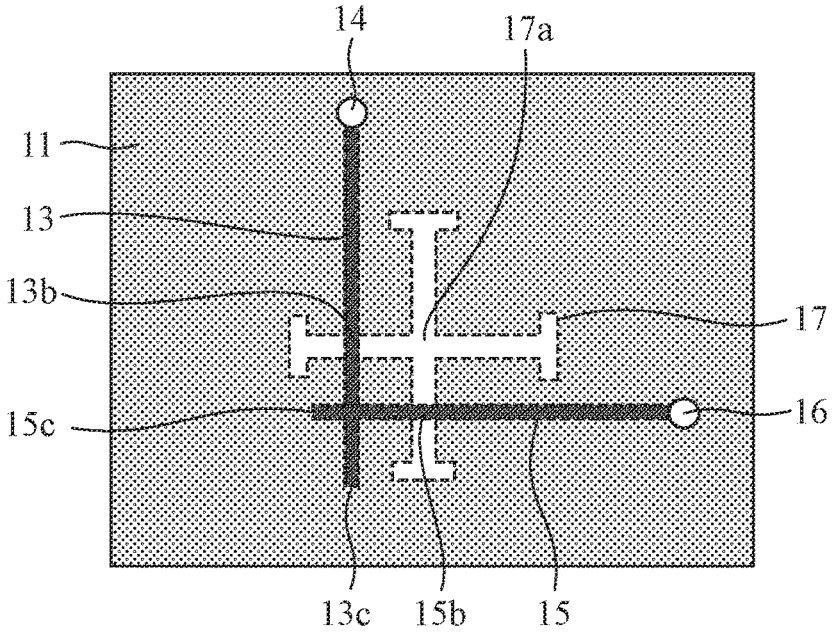
FIG. 11 is an explanatory diagram illustrating the positional relationship among the first stripline 13, the second stripline 15, and the slot 17.

However, this is merely an example, and for example as illustrated in FIG. 11, a first stripline 13 and a second stripline 15 may be disposed in such a manner that each of a midpoint 13*b* of the first stripline 13 and a midpoint 15*b* of the second stripline 15 is offset from the center 17*a* of a slot 17.

FIG. 11 is an explanatory diagram illustrating the positional relationship among the first stripline 13, the second stripline 15, and the slot 17.

Fourth Embodiment

In a fourth embodiment, an array antenna device including first striplines 23, second striplines 24, and slots 17 as feed line portions will be described.

Figure 12:
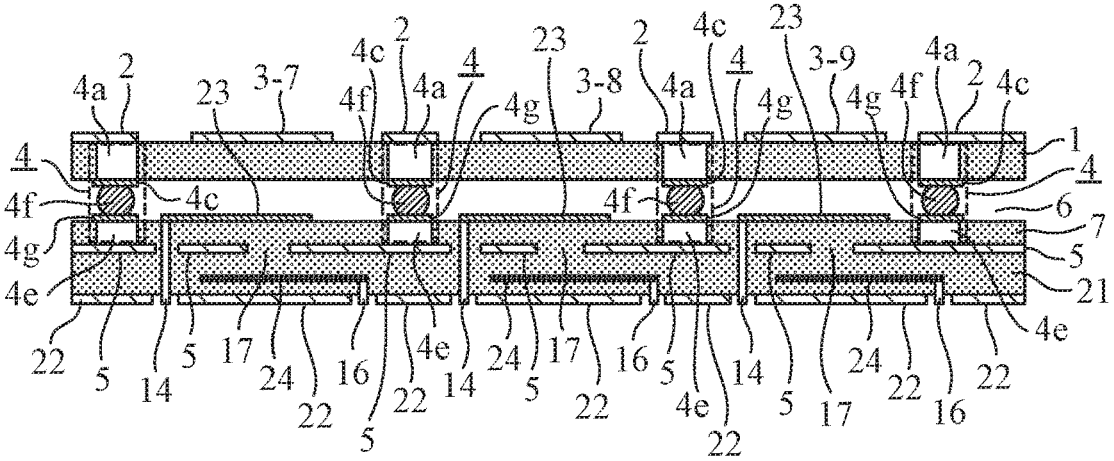
FIG. 12 is a cross-sectional view illustrating an array antenna device according to a fourth embodiment of the invention.

FIG. 12 is a cross-sectional view illustrating an array antenna device according to the fourth embodiment of the present invention.

A plan view of the array antenna device of the fourth embodiment is illustrated in FIG. 1 as in the first embodiment.

In FIG. 12, the same symbol as that in FIGS. 1 and 5 represents the same or a corresponding part and thus description thereof is omitted.

A third dielectric substrate 21 is disposed on, of the two planes of a second conductor ground plane 5, a plane opposite to the plane to which conductive members 4 are coupled.

A third conductor ground plane 22 is a ground plane of copper foil disposed on, of the two planes of the third dielectric substrate 21, a plane opposite to the plane on which the second conductor ground plane 5 is disposed.

Of the two planes of a second dielectric substrate 7, a first stripline 23 is provided at a position facing one patch antenna 3 out of the patch antennas 3-1 to 3-9 on a plane opposite to the plane on which the second conductor ground plane 5 is disposed.

A second stripline 24 is provided at a position facing one patch antenna 3 out of the patch antennas 3-1 to 3-9 inside the third dielectric substrate 21.

The positional relationship among a first stripline 23, a second stripline 24, and a slot 17 in the array antenna device illustrated in FIG. 12 is represented by FIG. 8, 10, or 11 as in the third embodiment.

Next, the operation will be described.

A first stripline 23 in a feed line portion is fed with, for example, a first polarized wave, and a second stripline 24 is fed with a second polarized wave orthogonal to the first polarized wave.

A slot 17 in the feed line portion has a cross slot structure in which the polarized waves orthogonal to each other can be excited, and the first polarized wave and the second polarized wave are fed with power in a contactless manner from the first stripline 23 and the second stripline 24.

The slot 17 is coupled to a patch antenna 3 at the opposite position and excites the patch antenna 3 at the opposite position when the first polarized wave and the second polarized wave are fed with power in a contactless manner from the first stripline 23 and the second stripline 24.

As a result, the slot 17 and the patch antenna 3 operate as an antenna.

Since the patch antennas 3 are excited using the slots 17 in the fourth embodiment, it is possible to implement an array antenna device in which cross polarization is suppressed.

Moreover, since polarized waves orthogonal to each other are fed to the first striplines 23 and the second striplines 24, a circularly polarized wave can be radiated from the patch antennas 3.

Figure 13:
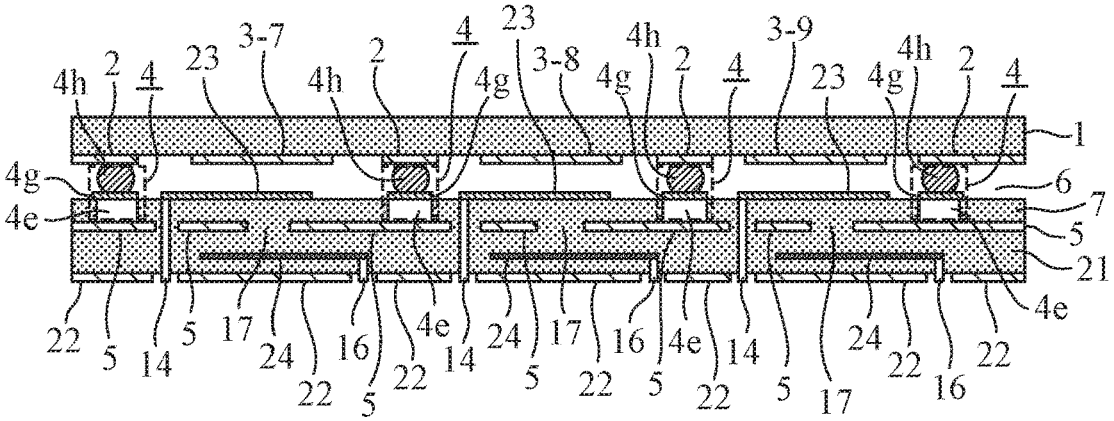
FIG. 13 is a cross-sectional view illustrating another array antenna device according to the fourth embodiment of the invention.

The example is illustrated in the fourth embodiment in which the first conductor ground plane 2 is formed on the front surface of the first dielectric substrate 1; however as illustrated in FIG. 13, the first conductor ground plane 2 may be formed on the back surface of the first dielectric substrate 1.

FIG. 13 is a cross-sectional view illustrating another array antenna device according to the fourth embodiment of the invention.

In FIG. 13, the same symbol as that in FIGS. 1, 6, and 12 represents the same or a corresponding part. Even in a case where the first conductor ground plane 2 is formed on the back surface of the first dielectric substrate 1, a slot 17 can excite a patch antenna 3 at the opposite position like in the case where the first conductor ground plane 2 is formed on the front surface of the first dielectric substrate 1.

Fifth Embodiment

In a fifth embodiment, an array antenna device including an adjustment circuit 32 for adjusting the phase and the amplitude of signals transmitted or received by patch antennas 3-1 to 3-9 will be described.

Figure 14:
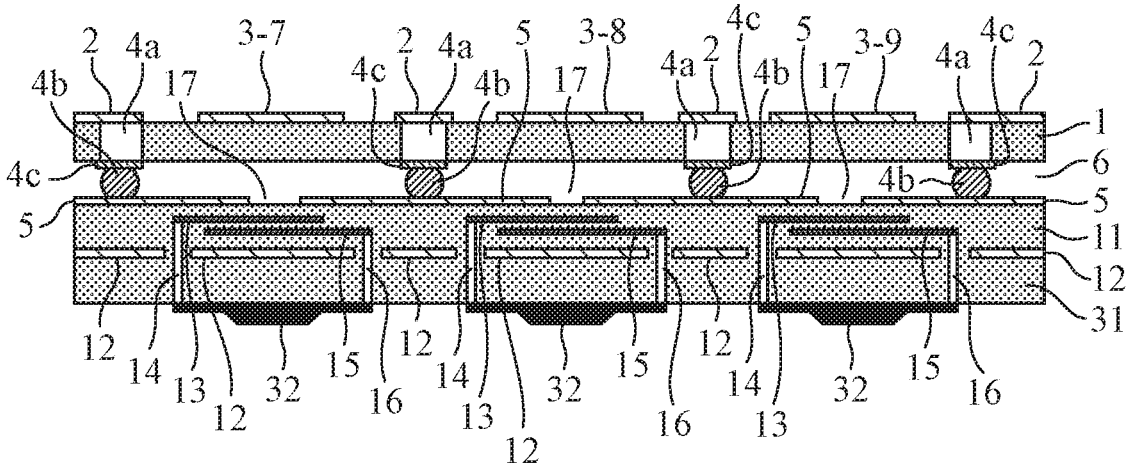
FIG. 14 is a cross-sectional view illustrating an array antenna device according to a fifth embodiment of the invention.

FIG. 14 is a cross-sectional view illustrating an array antenna device according to the fifth embodiment of the present invention.

A plan view of the array antenna device of the fifth embodiment is illustrated in FIG. 1 as in the first embodiment.

In FIG. 14, the same symbol as that in FIGS. 1, 2, and 7 represents the same or a corresponding part and thus description thereof is omitted.

A third dielectric substrate 31 is disposed on, of the two planes of a third conductor ground plane 12, a plane opposite to the plane on which a second dielectric substrate 11 is disposed.

An adjustment circuit 32 is disposed on, of the two planes of the third dielectric substrate 31, a plane opposite to the plane on which the third conductor ground plane 12 is disposed and is electrically coupled to a first stripline 13 via a via 14 and to a second stripline 15 via a via 16.

The adjustment circuit 32 is an integrated circuit (IC) for adjusting the phase and the amplitude of a signal transmitted or received by one patch antenna 3 out of patch antennas 3-1 to 3-9 that is provided at the opposite position.

The example is illustrated in FIG. 14 in which the first conductor ground plane 2 is formed on the front surface of the first dielectric substrate 1; however as illustrated in FIG. 9, adjustment circuits 32 may be provided in the array antenna device in which the first conductor ground plane 2 is used in the back surface of the first dielectric substrate 1.

Moreover, as illustrated in FIGS. 12 and 13, adjustment circuits 32 may be used in the array antenna device including the first striplines 23, the second striplines 24, and the slots 17 as the feed line portions.

Since the array antenna device illustrated in FIGS. 12 and 13 includes the first dielectric substrate 1, the second dielectric substrate 7, and the third dielectric substrate 21, the third dielectric substrate 31 illustrated in FIG. 14 is regarded as a fourth dielectric substrate.

An adjustment circuit 32 is electrically coupled to a first stripline 23 via a via 14 and is electrically coupled to a second stripline 24 via a via 16.

With the array antenna device including the adjustment circuits 32, an array antenna device capable of beam scanning in a desired direction can be implemented.

Sixth Embodiment

In a sixth embodiment, each of the patch antennas 3-1 to 3-9 formed in a first conductor ground plane 2 is a first patch antenna.

In the sixth embodiment, an array antenna device will be described in which second patch antennas 8-1 to 8-9 are provided on, of the two planes of a second dielectric substrate 7, a plane to which a plurality of conductive members 4 is coupled.

Figure 15:
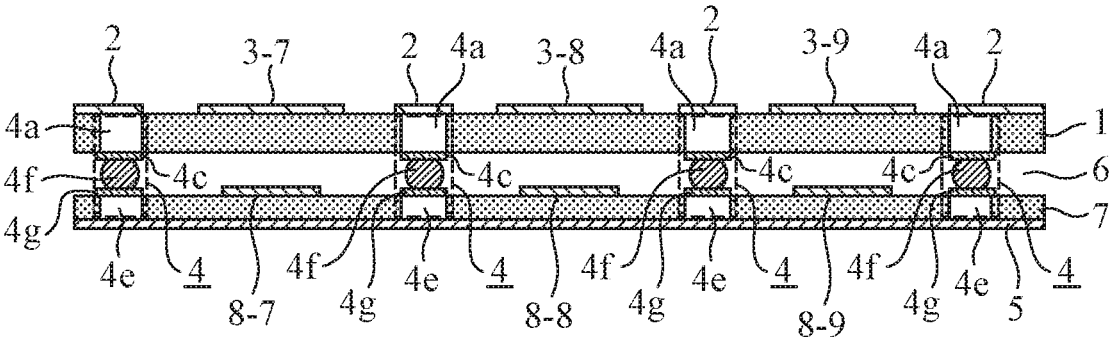
FIG. 15 is a cross-sectional view illustrating an array antenna device according to a sixth embodiment of the invention.

FIG. 15 is a cross-sectional view illustrating an array antenna device according to the sixth embodiment of the present invention.

A plan view of the array antenna device of the sixth embodiment is illustrated in FIG. 1 as in the first embodiment.

In FIG. 15, the same symbol as that in FIGS. 1, 5, and 6 represents the same or a corresponding part and thus description thereof is omitted.

The second patch antennas 8-1 to 8-9 are provided on, of the two planes of the second dielectric substrate 7, the plane to which the plurality of conductive members 4 is coupled.

Only the second patch antennas 8-7 to 8-9 are illustrated in FIG. 15, and illustration of the second patch antennas 8-1 to 8-6 is omitted.

The second patch antennas 8-1 to 8-9 are disposed at positions overlapping with the patch antennas 3-1 to 3-9, respectively, when viewed from the first dielectric substrate 1 toward the second dielectric substrate 7 side.

The second patch antennas 8-1 to 8-9 perform multiple resonance with the patch antennas 3-1 to 3-9, respectively.

Since the array antenna device of the sixth embodiment includes the second patch antennas 8-1 to 8-9, the resonance frequency of the antenna is expanded than that of the array antenna device of the first embodiment. Therefore, the array antenna device of the sixth embodiment is capable of performing beam scanning at a wide angle over a broadband as compared with the array antenna device of the first embodiment.

In the array antenna device illustrated in FIG. 15, the second patch antennas 8-1 to 8-9 are used in the array antenna device in which a first conductor ground plane 2 is provided on the front surface of the first dielectric substrate 1.

Figure 16:
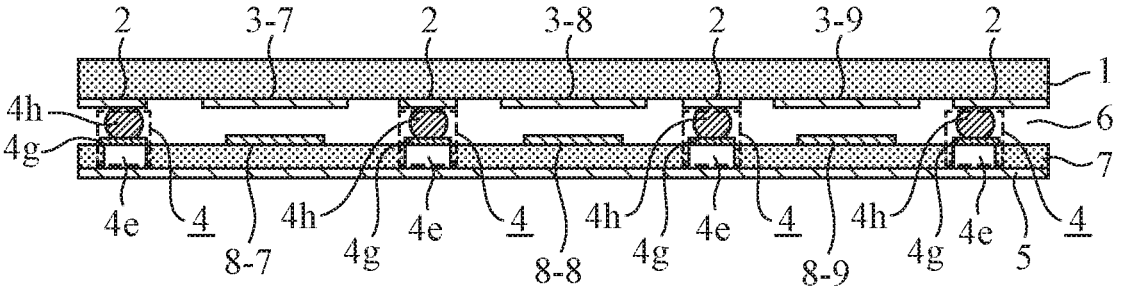
FIG. 16 is a cross-sectional view illustrating another array antenna device according to the sixth embodiment of the invention.

However, this is merely an example, and the second patch antennas 8-1 to 8-9 may be used in the array antenna device in which the first conductor ground plane 2 is formed on the back surface of the first dielectric substrate 1 as illustrated in FIG. 16.

FIG. 16 is a cross-sectional view illustrating another array antenna device according to the sixth embodiment of the invention.

Seventh Embodiment

In a seventh embodiment, an array antenna device will be described in which an air layer 6 is a first air layer, third connection conductors **4*f* are first spacers, and second spacers for forming a second air layer 9 between a second conductor ground plane 5 and a second dielectric substrate 7** are included.

Figure 17:
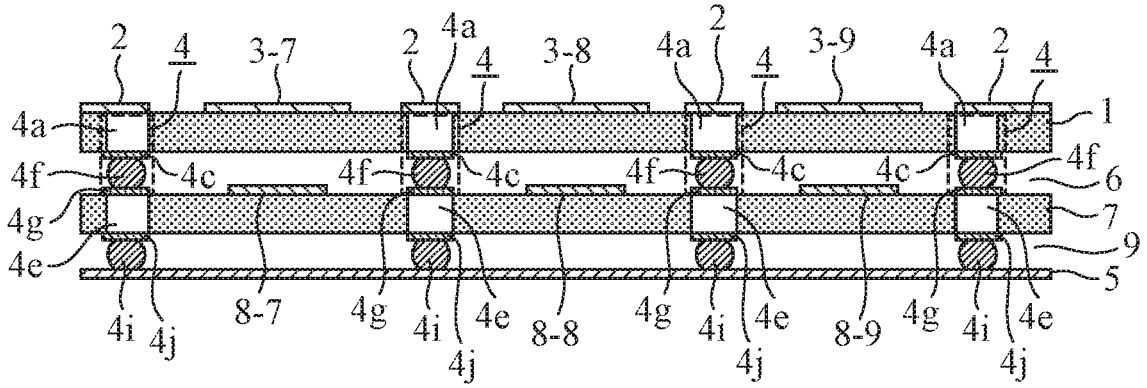
FIG. 17 is a cross-sectional view illustrating an array antenna device according to a seventh embodiment of the invention.

FIG. 17 is a cross-sectional view illustrating an array antenna device according to the seventh embodiment of the present invention.

A plan view of the array antenna device of the seventh embodiment is illustrated in FIG. 1 as in the first embodiment.

In FIG. 17, the same symbol as that in FIGS. 1 and 15 represents the same or a corresponding part and thus description thereof is omitted.

Fourth connection conductors **4*i* function as the second spacers that form the second air layer 9 between the second conductor ground plane 5 and the second dielectric substrate 7**.

A land **4*j* is a portion where a second connection conductor 4*e* and the fourth connection conductor 4*i*** are coupled by solder.

Since the array antenna device of the seventh embodiment includes the second patch antennas 8-1 to 8-9, the resonance frequency of the antenna is expanded than that of the array antenna device of the first embodiment. Therefore, the array antenna device of the seventh embodiment is capable of performing beam scanning at a wide angle over a wide band as compared with the array antenna device of the first embodiment.

Furthermore, since the array antenna device of the seventh embodiment includes the second air layer 9, better axial ratio characteristics in the wide-angle direction can be obtained than in the array antenna device of the first embodiment.

In the array antenna device illustrated in FIG. 17, the second air layer 9 is formed in the array antenna device in which a first conductor ground plane 2 is provided on the front surface of a first dielectric substrate 1.

Figure 18:
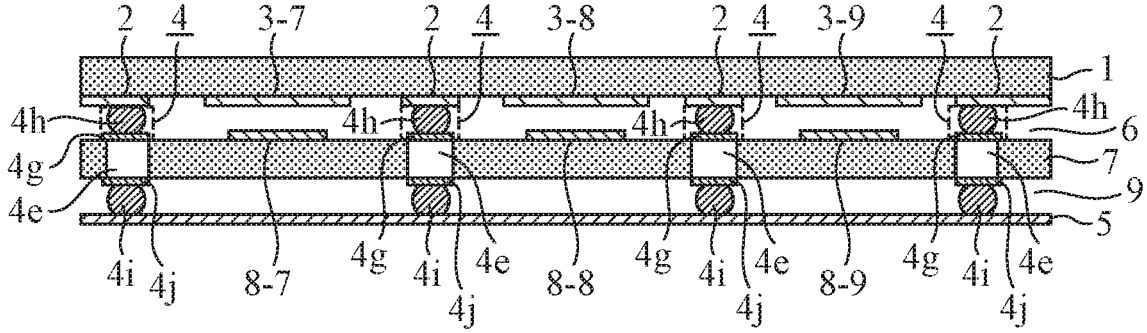
FIG. 18 is a cross-sectional view illustrating another array antenna device according to the seventh embodiment of the invention.

However, this is merely an example, and the second air layer 9 may be formed in the array antenna device in which the first conductor ground plane 2 is formed on the back surface of the first dielectric substrate 1 as illustrated in FIG. 18.

FIG. 18 is a cross-sectional view illustrating another array antenna device according to the seventh embodiment of the invention.

Eighth Embodiment

In the eighth embodiment, an array antenna device will be described in which first striplines 13 and second striplines 15 are wired in the same plane, and each of the first striplines 13 and the second striplines 15 excites patch antennas 3-1 to 3-9.

Figure 19:
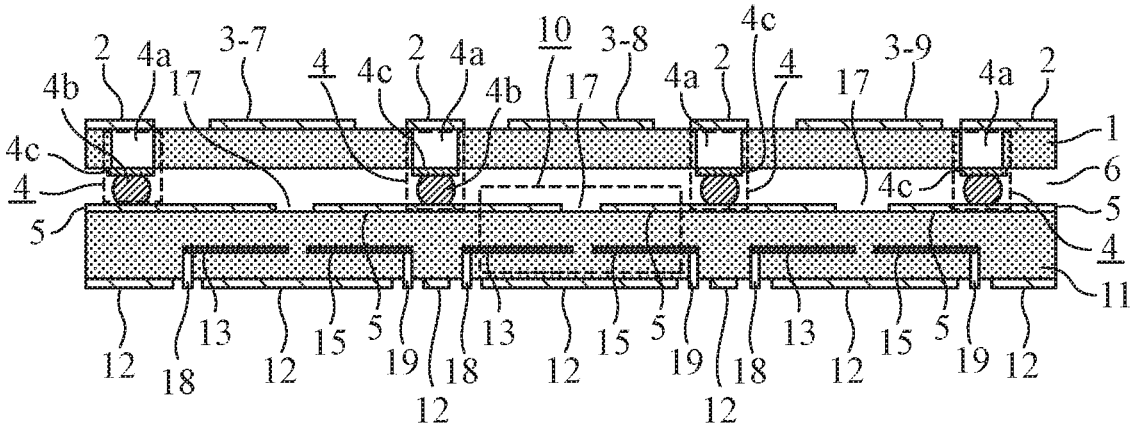
FIG. 19 is a cross-sectional view illustrating an array antenna device according to an eighth embodiment of the invention.

FIG. 19 is a cross-sectional view illustrating an array antenna device according to the eighth embodiment of the present invention.

A plan view of the array antenna device of the eighth embodiment is illustrated in FIG. 1 as in the first embodiment. In FIG. 19, the same symbol as that in FIGS. 1, 7, and 9 represents the same or a corresponding part and thus description thereof is omitted.

In the array antenna device illustrated in FIG. 19, first striplines 13 and second striplines 15 are wired on the same plane inside a second dielectric substrate 11.

One end of a via 18 is coupled to a first stripline 13, and the other end protrudes from the array antenna device.

One end of a via 19 is coupled to a second stripline 15, and the other end protrudes from the array antenna device.

The vias 18 and the vias 19 have the same length.

Figure 20:
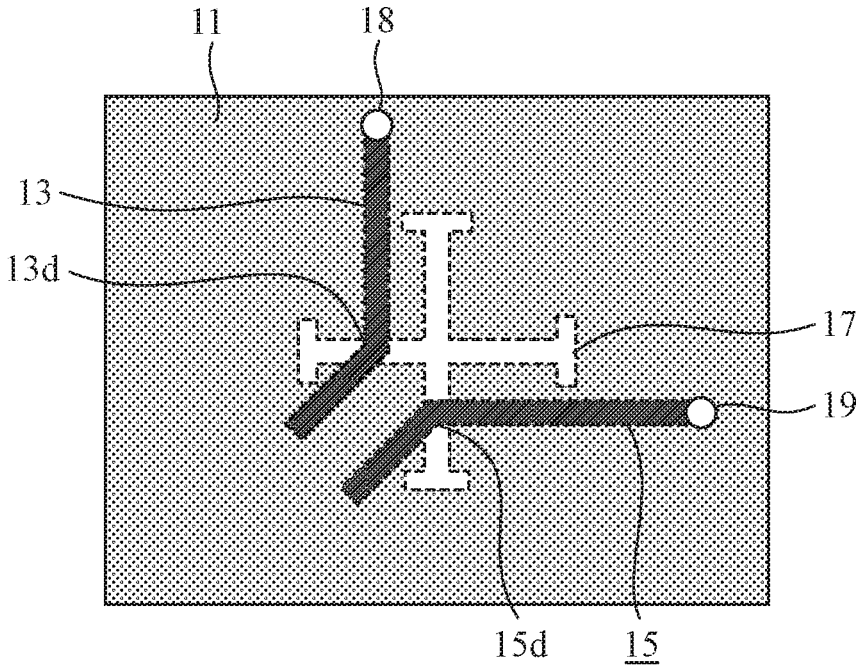
FIG. 20 is a plan view illustrating the positional relationship between a first stripline 13 and a second stripline 15.

FIG. 20 is a plan view illustrating the positional relationship between a first stripline 13 and a second stripline 15.

In FIG. 20, the first stripline 13 is disposed in such a manner that a midpoint 13*d* overlaps with a slot extending in the lateral direction in the drawing of a slot 17.

The second stripline 15 is also disposed in such a manner that a midpoint 15*d* overlaps with a slot extending in the longitudinal direction in the drawing of a slot 17 in FIG. 20.

Since the first striplines 13 and the second striplines 15 are wired on the same plane in the array antenna device of the eighth embodiment, the impedance characteristics of the antenna seen from the input side are substantially the same. Therefore, the array antenna device of the eighth embodiment has better symmetry and better axial ratio characteristics than the array antenna device of the third and fourth embodiments.

Note that the present invention may include a flexible combination of the respective embodiments, a modification of any component of the embodiments, or an omission of any component in the embodiments within the scope of the present invention.

INDUSTRIAL APPLICABILITY

The present invention is suitable for an array antenna device including a plurality of patch antennas.

REFERENCE SIGNS LIST

1: First dielectric substrate, 2: First conductor ground plane, 2*a*: Conductor-cut-out portion, 3-1 to 3-9: Patch antenna, 4: Conductive member, 4*a*: First connection conductor, 4*b*: Second connection conductor, 4*c*: Land, 4*d*: First connection conductor, 4*e*: Second connection conductor, 4*f*: Third connection conductor, 4*g*: Land, 4*h*: First connection conductor, 4*i*: Fourth connection conductor, 4*j*: Land, 5: Second conductor ground plane, 6: Air layer, 7: Second dielectric substrate, 8-1 to 8-9: Second patch antenna, 9: Second air layer, 10: Feed line portion, 11: Second dielectric substrate, 12: Third conductor ground plane, 13: First stripline, 13*a*: Branch line, 13*b*: Midpoint, 13*c*: Tip, 13*d*: Midpoint, 14, 16: Via, 15: Second stripline, 15*a*: Branch line, 15*b*: Midpoint, 15*c*: Tip, 15*d*: Midpoint, 17: Slot, 17*a*: Slot center, 18, 19: Via, 21: Third dielectric substrate, 22: Third conductor ground plane, 23: First stripline, 24: Second stripline, 31: Third dielectric substrate, 32: Adjustment circuit.

The invention claimed is:

1. An array antenna device comprising:

a first dielectric substrate provided with a first conductor ground plane on a front surface or a back surface thereof;

a plurality of patch antennas provided in the first conductor ground plane;

a plurality of conductive members, ends of which are connected to the first conductor ground plane to surround the patch antennas individually; and a second conductor ground plane connected to each of other ends of the conductive members, wherein the first conductor ground plane is provided on one of, (a) the front surface of the first dielectric substrate, a part of the plurality of conductive members penetrates the first dielectric substrate, and a remaining part of the plurality of conductive members functions as spacers for providing an air layer between the first dielectric substrate and the second conductor ground plane, and (b) the back surface of the first dielectric substrate, the plurality of conductive members functions as spacers for providing an air layer between the first conductor ground plane and the second conductor ground plane, wherein the conductive member adjacent to at least two or more patch antennas, among the plurality of patch antennas, out of the plurality of conductive members, is disposed at a position equidistant from a center of each of the at least two or more patch antennas, adjacent to one another.

2. The array antenna device according to claim 1, wherein the first conductor ground plane is provided on the front surface of the first dielectric substrate, each of the conductive members comprises:

a first connection conductor provided so as to penetrate the first dielectric substrate and connected to the first conductor ground plane at one end thereof at a position surrounding one of the patch antennas; and a second connection conductor electrically connecting another end of the first connection conductor and the second conductor ground plane, and the second connection conductor functions as a spacer for providing an air layer between the first dielectric substrate and the second conductor ground plane.

3. The array antenna device according to claim 1, wherein, when the first conductor ground plane is provided on the back surface of the first dielectric substrate, each of the conductive members is a first connection conductor connected to the first conductor ground plane at one end thereof and connected to the second conductor ground plane at another end thereof at a position surrounding one of the patch antennas, and the first connection conductor functions as a spacer for providing an air layer between the first conductor ground plane and the second conductor ground plane.

4. The array antenna device according to claim 1, wherein each of the patch antennas has a circular shape.

5. An array antenna device comprising:

a first dielectric substrate provided with a first conductor ground plane on a front surface or a back surface thereof;

a plurality of patch antennas provided in the first conductor ground plane;

a plurality of conductive members, ends of which are connected to the first conductor ground plane to surround the patch antennas individually; and a second conductor ground plane connected to each of other ends of the conductive members, wherein the first conductor ground plane is provided on one of, (a) the front surface of the first dielectric substrate, a part of the plurality of conductive members penetrates the first dielectric substrate, and a remaining part of the plurality of conductive members functions as spacers for providing an air layer between the first dielectric substrate and the second conductor ground plane, and (b) the back surface of the first dielectric substrate, the plurality of conductive members functions as spacers for providing an air layer between the first conductor ground plane and the second conductor ground plane, wherein the conductive member adjacent to at least two or more patch antennas among the plurality of patch antennas, out of the plurality of conductive members, is disposed at a position equidistant from a center of each of the at least two or more patch antennas adjacent to each other, the array antenna device further comprising:

a second dielectric substrate disposed between the first dielectric substrate and the second conductor ground plane in a case where the first conductor ground plane is provided on the front surface of the first dielectric substrate, the second dielectric substrate being disposed between the first conductor ground plane and the second conductor ground plane in a case where the first conductor ground plane is provided on the back surface of the first dielectric substrate, wherein in the case where the first conductor ground plane is provided on the front surface of the first dielectric substrate, a part of the plurality of conductive members penetrates the first and second dielectric substrates, and the remaining part of the plurality of conductive members functions as spacers for providing an air layer between the first dielectric substrate and the second dielectric substrate, and in the case where the first conductor ground plane is provided on the back surface of the first dielectric substrate, a part of the plurality of conductive members penetrates the second dielectric substrate, and the remaining part of the plurality of conductive members functions as spacers for providing an air layer between the first conductor ground plane and the second dielectric substrate.

6. The array antenna device according to claim 5, wherein, when the first conductor ground plane is provided on the front surface of the first dielectric substrate, each of the conductive members comprises:

a first connection conductor provided to penetrate the first dielectric substrate and connected to the first conductor ground plane at one end thereof at a position surrounding one of the patch antennas;

a second connection conductor provided to penetrate the second dielectric substrate and connected to the second conductor ground plane at one end thereof; and a third connection conductor electrically connecting another end of the first connection conductor and another end of the second connection conductor, and the third connection conductor functions as a spacer for providing an air layer between the first dielectric substrate and the second dielectric substrate.

7. The array antenna device according to claim 5, wherein, when the first conductor ground plane is provided on the back surface of the first dielectric substrate, each of the conductive members comprises:

a first connection conductor connected to the first conductor ground plane at one end thereof at a position surrounding one of the patch antennas; and a second connection conductor provided so as to penetrate the second dielectric substrate and connected to the second conductor ground plane at one end thereof, and the first connection conductor functions as a spacer for providing an air layer between the first conductor ground plane and the second dielectric substrate.

8. The array antenna device according to claim 5, further comprising:

a third dielectric substrate disposed on, of two planes of the second conductor ground plane, a plane opposite to the plane on which the second dielectric substrate is disposed;

a third conductor ground plane disposed on, of two planes of the third dielectric substrate, a plane opposite to the plane on which the second conductor ground plane is disposed;

a plurality of first striplines provided on, of two planes of the second dielectric substrate, a plane opposite to the plane on which the second conductor ground plane is disposed at positions facing the patch antennas individually;

a plurality of second striplines disposed inside the third dielectric substrate at positions facing the patch antennas individually; and a plurality of slots formed inside the second conductor ground plane at positions facing the patch antennas individually, wherein each of the slots excites one of the patch antennas provided at an opposite position when power is fed from one of the first striplines and one of the second striplines.

9. The array antenna device according to claim 8, further comprising:

a fourth dielectric substrate disposed on, of two planes of the third conductor ground plane, a plane opposite to the plane on which the third dielectric substrate is disposed; and a plurality of adjustment circuits for adjusting a phase and an amplitude of a signal transmitted or received by one of the patch antennas, the plurality of adjustment circuits disposed on, of two planes of the fourth dielectric substrate, a plane opposite to the plane on which the third conductor ground plane is disposed, each of the adjustment circuits electrically connected to each of the first and second striplines provided at positions opposite to one of the patch antennas.

10. The array antenna device according to claim 5, wherein each of the patch antennas provided in the first conductor ground plane is a first patch antenna, and a plurality of second patch antennas are provided on, of two planes of the second dielectric substrate, a plane to which the plurality of conductive members is connected.

11. The array antenna device according to claim 10, wherein the air layer is a first air layer, the spacers are first spacers, and the array antenna device further comprises second spacers for forming a second air layer between the second conductor ground plane and the second dielectric substrate.

12. The array antenna device according to claim 5, wherein first striplines and second striplines are wired on a same plane inside the second dielectric substrate, and each of the first striplines and the second striplines excites the patch antennas.

13. The array antenna device according to claim 5, wherein each of the patch antennas has a circular shape.

14. An array antenna device comprising:

a first dielectric substrate provided with a first conductor ground plane on a front surface or a back surface thereof;

a plurality of patch antennas provided in the first conductor ground plane;

a plurality of conductive members, ends of which are connected to the first conductor ground plane to surround the patch antennas individually; and a second conductor ground plane connected to each of other ends of the conductive members, wherein the first conductor ground plane is provided on one of, (a) the front surface of the first dielectric substrate, a part of the plurality of conductive members penetrates the first dielectric substrate, and a remaining part of the plurality of conductive members functions as spacers for providing an air layer between the first dielectric substrate and the second conductor ground plane, and (b) the back surface of the first dielectric substrate, the plurality of conductive members functions as spacers for providing an air layer between the first conductor ground plane and the second conductor ground plane, wherein the conductive member adjacent to at least two or more patch antennas among the plurality of patch antennas, out of the plurality of conductive members, is disposed at a position equidistant from a center of each of the at least two or more patch antennas adjacent to each other, the array antenna device further comprising:

a second dielectric substrate disposed on, of two planes of the second conductor ground plane, a plane opposite to the plane to which the plurality of conductive members is connected;

a third conductor ground plane disposed on, of two planes of the second dielectric substrate, a plane opposite to the plane on which the second conductor ground plane is provided;

a plurality of first and second striplines disposed inside the second dielectric substrate at positions facing the patch antennas individually; and a plurality of slots provided in the second conductor ground plane at positions facing the patch antennas individually, wherein each of the slots excites one of the patch antennas provided at an opposite position when power is fed from one of the first striplines and one of the second striplines.

15. The array antenna device according to claim 14, further comprising:

a third dielectric substrate disposed on, of two planes of the third conductor ground plane, a plane opposite to the plane on which the second dielectric substrate is disposed; and a plurality of adjustment circuits for adjusting a phase and an amplitude of a signal transmitted or received by one of the patch antennas, the plurality of adjustment circuits disposed on, of two planes of the third dielectric substrate, a plane opposite to the plane on which the third conductor ground plane is disposed, each of the adjustment circuits electrically connected to each of the first and second striplines provided at positions opposite to one of the patch antennas.

16. The array antenna device according to claim 14, wherein each of the patch antennas has a circular shape.

* * * * *